US007132062B1

(12) United States Patent
Howard

(10) Patent No.: US 7,132,062 B1
(45) Date of Patent: Nov. 7, 2006

(54) ELECTRICALLY CONDUCTIVE ADDITIVE SYSTEM AND METHOD OF MAKING SAME

(75) Inventor: Kip A. Howard, Conneaut, OH (US)

(73) Assignee: Plasticolors, Inc., Ashtabula, OH (US)

( * ) Notice: Subject to any disclaimer, the term of this patent is extended or adjusted under 35 U.S.C. 154(b) by 328 days.

(21) Appl. No.: 10/870,105

(22) Filed: Jun. 17, 2004

Related U.S. Application Data

(63) Continuation of application No. 10/825,957, filed on Apr. 15, 2004, now abandoned.

(60) Provisional application No. 60/463,092, filed on Apr. 15, 2003.

(51) Int. Cl.
*H01B 1/00* (2006.01)

(52) U.S. Cl. ..... 252/500

(58) Field of Classification Search ..... 252/500; 428/368; 423/445–447.3; 524/496; 264/211; 429/27

See application file for complete search history.

(56) References Cited

U.S. PATENT DOCUMENTS 5,024,818 A 6/1991 Tibbetts et al.
5,165,909 A 11/1992 Tennent et al.
5,433,906 A 7/1995 Dasch et al.
5,591,382 A 1/1997 Nahass et al.
5,594,060 A 1/1997 Alig et al.
5,643,502 A 7/1997 Nahass et al.
5,846,509 A 12/1998 Alig et al.
6,001,919 A 12/1999 Yen et al.
6,103,373 A * 8/2000 Nishimura et al. ..... 428/368
6,156,256 A 12/2000 Kennel
6,506,355 B1 1/2003 Glasgow et al.
6,689,835 B1 2/2004 Amarasekera et al.
7,018,601 B1 * 3/2006 Yanagisawa et al. .... 423/447.1
2002/0086198 A1 7/2002 Ilno et al.
2002/0149004 A1 10/2002 Hayward et al.
2003/0116757 A1 6/2003 Miyoshi et al.
2006/0089434 A1 * 4/2006 Nodera ..... 524/115

* cited by examiner

*Primary Examiner*—Mark Kopec
*Assistant Examiner*—Tri Nguyen
(74) *Attorney, Agent, or Firm*—Benesch, Friedlander, Coplan & Aronoff LLP

(57) ABSTRACT

An electrically conductive additive system comprising carbon nanofibers and, optionally, electrically conductive particulate material mixed in a liquid component. The carbon nanofibers can be characterized by having a diameter between about 70 to about 200 nanometers, a length between about 50 to about 100 microns, and graphitic planes having a stacked cone-type structure.

12 Claims, 2 Drawing Sheets

ELECTRICALLY CONDUCTIVE ADDITIVE SYSTEM AND METHOD OF MAKING SAME

CROSS-REFERENCE TO RELATED APPLICATIONS

This application is a continuation of U.S. application Ser. No. 10/825,957 filed on Apr. 15, 2004 now abandoned, and claims the benefit of priority of U.S. Provisional Application No. 60/463,092 filed on Apr. 15, 2003, which are both hereby incorporated by reference in their entireties herein.

BACKGROUND

Electrostatic painting of various automobile parts, including doors and hoods, is commonly used today in the automotive industry. Electrostatic painting of sheet molding compound (SMC) substrates, for example, is desirable because it reduces paint waste and emissions as compared to non-electrostatic painting techniques. Electrostatic painting techniques require the substrate to be electrically conducting or to have an applied prep coat or primer, which is electrically conducting in order to display an increased paint transfer efficiency. Currently, an electrically conductive primer must be applied to a sheet molding compound composition article to be coated prior to electrostatically painting the article because, unlike steel, sheet molding composition is not conductive.

When using an electrically conducting primer, the path to ground is achieved via the conducting primer. An alternative technique is to use a grounding clip. This undesirably causes higher film builds near the grounding clip with film builds decreasing as the distance from the grounding clip increases. In addition, after several passes through the paint booth, significant resistance to ground may be encountered due to multiple paint layers on the buck itself.

As an alternative approach, electrically conductive thermoset composites have been produced for many years through the use of conductive grade carbon black pigments. However, this approach has included some complications.

The integral conductive network formed when using carbon blacks is not limited to the surface of the composite part alone. The entire matrix is rendered conductive, making it superior to conductive coatings in many applications. However, when formulating to achieve high levels of conductivity (for electrostatic painting, EMI, RFI) using carbon blacks, processing is drastically hindered because of the rheological impact on the SMC/BMC/RIM paste. Instances where these high levels are achieved and easily processed have encountered intermittent failures in conductivity due to instability in the conductive network of the carbon black pigments.

As a result, electrically conductive grade carbon black increases compound viscosity, modulus and conductivity. The tendency for these carbon blacks to flocculate (attractive forces acting to physically move carbon black particles together) provides carbon black with a low percolation threshold (the amount of a conductive material necessary to form a conductive network allowing for free election transfer between conductive particles) in most thermoset composite systems. Even with relatively low effective loadings, conductive carbon black pigments have a significant impact on the flow properties of thermoset composite systems. Therefore, glass reinforced thermoset composite production processes are presented with challenges when solely carbon black pigments are employed to provide conductivity.

BRIEF DESCRIPTION OF THE DRAWINGS

In the accompanying drawings and description that follow, like parts are indicated throughout the drawings and description with the same reference numerals, respectively. The figures are not drawn to scale and the proportions of certain parts have been exaggerated for convenience of illustration.

DETAILED DESCRIPTION

Figure 1:
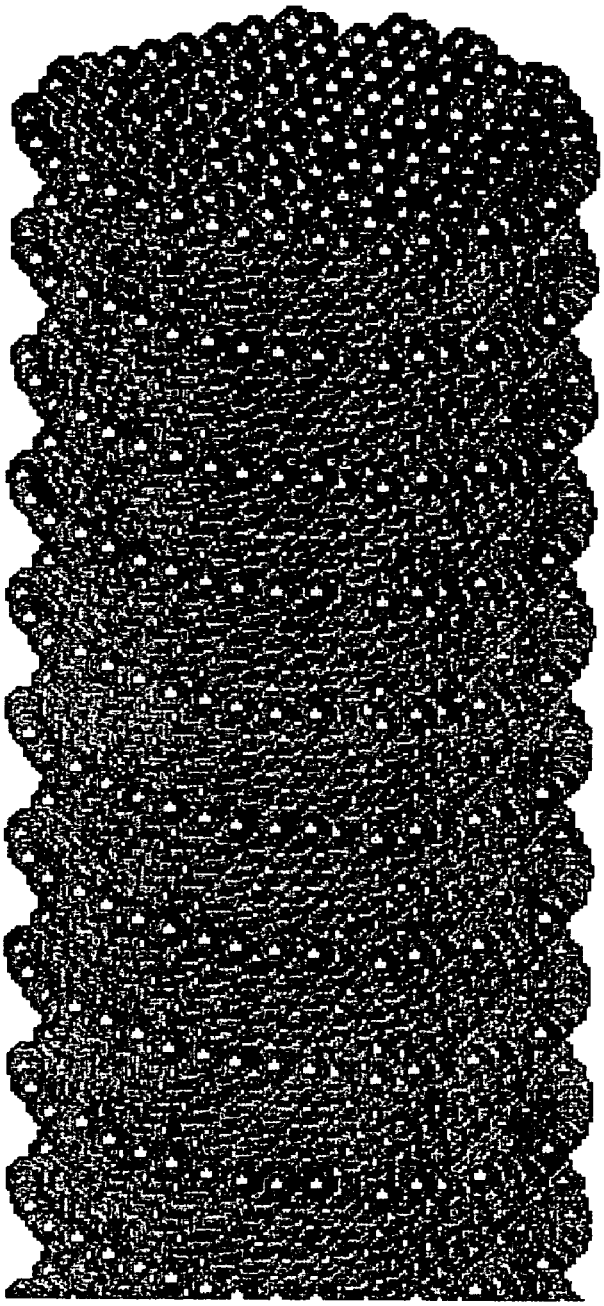
FIG. 1 is an illustration of a carbon nanofiber as described herein.

The subject application is directed to an electrically conductive additive system and a method of making the electrically conductive additive system. The electrically conductive additive system can be used in a sheet molding compound (SMC) composition to render the SMC composition electrically conductive and a method of making the electrically conductive additive system. The SMC composition can then be molded into an article that has a conductive surface where the article can be painted electrostatically without the use of an electrically conductive primer layer, as the sprayed paint will adhere directly to the surface of the electrically conductive article.

In one embodiment, the SMC composition can include a thermoset resin, fibrous reinforcing material, and an electrically conductive additive system. The electrically conductive additive system can be present in a sufficient quantity to render an article molded with the SMC composition with structural integrity and electrically conductive enough to be electrostatically painted. Optionally, the SMC composition can further include one or more of the following: monomer, low profile additive, filler, initiator, thickening agent (e.g., a metal oxide such as magnesium oxide and magnesium hydroxide), additive (e.g., UV stabilizer), pigment, and mold release agent.

The thermoplastic resin employed in the SMC composition may be selected from a variety of thermoset resins. As used herein, the term "thermoset resin" can refer to a resin that permanently cures or solidifies under heat and pressure, while the term "thermoplastic resin" can refer to a resin that has a linear macromolecular structure that repeatedly softens when heated and hardens when cooled. Examples of suitable thermoset resins include, but are not limited to, polystyrene resins, saturated polyester resins, polyurethane resins, epoxy resins, acrylic resins, phenolic resins, polyamide resins, silicones, styrene-butadiene rubber, synthetic rubber, natural rubber, and any combination thereof. Blends of thermoset resins as well as blends of thermoplastic resins with thermoset resins can also be utilized.

In one embodiment, the thermoset resin may be present in the SMC composition in amounts ranging from about 10 weight percent (wt %) to about 40 wt % of the total SMC composition minus the fibrous reinforcing material (e.g., glass fibers). In another embodiment, the thermoset resin may be present in the SMC composition in amounts ranging from about 15 wt % to about 20 wt % of the total SMC composition minus the fibrous reinforcing material.

The fibrous reinforcing material or reinforcing fibers employed in the SMC composition may be selected from a variety of fibrous reinforcing materials. Suitable fibrous reinforcing materials include, but are not limited to, glass fibers, carbon fiber, carbon fiber matt, preformed glass inserts and any combination thereof.

In one embodiment, the fibrous reinforcing material may be present in the SMC composition in amounts ranging from about 10 wt % to about 50 wt % of the total SMC composition. In another embodiment, the fibrous reinforcing material may be present in the SMC composition in amounts ranging from about 20 wt % to about 40 wt % of the total SMC composition.

In one embodiment, the electrically conductive additive system can include a liquid component and carbon nanofibers dispersed in the liquid component. Optionally, the electrically conductive additive system can further include other electrically conductive particulate materials.

The liquid component used in the electrically conductive additive system may be selected from a variety of liquid components. Suitable liquid components include, but are not limited to, polyester grinding vehicles, polyol grinding vehicles, epoxies, plasticizers (e.g., butyl benzyl phthalate, DIDP, etc.), monomers (e.g., styrene, divinyl benzene, vinyl toluene, etc.), and combinations thereof.

In one embodiment, the liquid component can be present in the electrically conductive additive system in amounts ranging from about 75 wt % to about 98 wt % of the total electrically conductive additive system. In another embodiment, the liquid component may be present in the electrically conductive additive system in amounts ranging from about 80 wt % to about 97 wt % of the total electrically conductive additive system.

As stated above, the electrically conductive additive system can also include carbon nanofibers. As used herein, the term "carbon nanofibers" can refer to vapor grown carbon fibers having high surface energy and high surface area. Carbon nanofibers of this type are grown in accordance with U.S. Pat. No. 6,506,355 to Glasgow et al., which is hereby incorporated by reference in its entirety herein, and can be acquired by Pyrograf Products, Inc. under the trade name Pyrograph III. These carbon nanofibers can be produced in the vapor phase by decomposing either methane, ethane, or other aliphatic hydrocarbons, or coal gas in the presence of an iron catalyst such as iron pentacarbonyl ($Fe(CO)_5$), hydrogen sulfide and ammonia. These carbon nanofibers can be characterized by a diameter of about 70 to about 200 nanometers and a length of about 50 to about 100 microns. The physical form of the nanofibers can be large, entangled "bird nest" agglomerates in bulk form. The graphitic planes of each of the carbon nanofibers can have a stacked cone-type structure for the inner (catalytic) portion of the fiber. As shown in FIG. 1, the cones can be approximately 27 degrees off the carbon nanofiber axis. In addition, the carbon nanofibers can have a chemical vapor deposited (CVD) layer of carbon on the outside of the nested conic sections. As stated above, the carbon nanofibers can be further characterized as having high surface energy and high surface area. The nanofibers can have a surface area in the range between about 10 to about 25 $m^2$/gm. Dispersive surface energies can range from between about 20 to about 285 $mJ/m^2$.

In one embodiment, the carbon nanofibers may be present in the electrically conductive additive system in amounts ranging from about 1 wt % to about 15 wt % of the total electrically conductive additive system. In another embodiment, the carbon nanofibers may be present in the electrically conductive additive system in amounts ranging from about 1 wt % to about 3 wt % of the total electrically conductive additive system.

As stated above, the electrically conductive additive system can also include other electrically conductive particulate materials such as electrically conductive carbon black. Other suitable electrically conductive particulate materials include, but are not limited to, metallic particulates (e.g., electrically conductive metals such as aluminum, silver, nickel, etc. in the form of a granule, flake, sphere of varying size and size distributions), non-electrically conductive grade carbon black, particles or fibers coated with electrically conductive materials, carbon fibers, doped pigments (e.g., titanium dioxide, indium oxide, etc. that have been doped with a material that renders the crystals electrically conductive such as the Dupont, Zelec products), inherently conductive polymers (i.e., a class of polymeric materials having conjugated chain configurations giving them the intrinsic ability to transfer electrons like a semiconductor, such as polyacetylene, polyaniline, etc.), mica, and combinations thereof. Those particles or fibers coated with electrically conductive materials can include electrically conductive or non-conductive core particles (e.g., graphite, carbon black, titanium dioxide, clay, calcium carbonate, mica, silica, etc.) coated with a conductive material (e.g., an inherently conductive polymer, steel, silver, aluminum, nickel, etc.). Various grades of mica can be electrically conductive by means of natural conditions, coating, metal oxide surface treatment, etc. The flat platelet particle geometry gives these material a high aspect ratio making them especially useful in a synergy with carbon nanotubes. The mica particles orient parallel to the flow of compound during processing and molding and the carbon nanotubes act to bridge the void between the surfaces of mica particles completing the continuous conductive network. Optionally, the electrically conductive additive system can further include dispersing agents.

While not wishing to be bound by theory, it has been discovered that a synergistic effect may exist in reinforced thermoset composites between other electrically conductive particulate materials and the carbon nanofibers, which acts to lower the required loadings of both species and provide a more stable and robust conductive property.

In one embodiment, the electrically conductive particulate material may be present in the electrically conductive additive system in amounts ranging from about 1 wt % to about 20 wt % of the total electrically conductive additive system. In another embodiment, the electrically conductive particulate materials may be present in the electrically conductive additive system in amounts ranging from about 1 wt % to about 8 wt % of the total electrically conductive additive system.

Although the relative quantities of thermoset resin, carbon nanofibers and optional electrically conductive particulate material are set forth above in general terms, the precise quantities will depend on the particular resin, carbon nanofiber, and electrically conductive particulate materials as well as the desired conductivity and physical properties of the final composition.

In one embodiment, the electrically conductive additive system can be processed by adding the carbon nanofibers to the liquid component. In one embodiment, the carbon nanofibers in the liquid component can be de-agglomerated or de-tangled using one of various particle reduction or de-agglomeration techniques. For example, a three-roll mill can be used to relax and de-agglomerate the carbon nanofibers in the liquid component.

In one embodiment, the three-roll mill can be a 10"×22" three roll mill having a 15 horsepower motor and a nip pressure of 250 psi at the batch and middle roll. The speeds of the rolls to de-agglomerate the carbon nanofibers in the liquid component can be as follows: batch roll—59 rpm, middle roll—150 rpm, and feed roll 300 rpm. It will be appreciated that other particle reduction or de-agglomeration techniques can be used by mechanical, chemical or physical processing means. For example, other techniques that may be employed include, but are not limited to, media milling, Cowels blade dispersing, vertical and horizontal media milling, basket milling, attritors, pulverization, exfoliation, dissolution, precipitation, explosion, and sublimation.

In one embodiment, the milling parameters can be adjusted until a transparent film is achieved on the batch roll, indicating that maximum efficiency has been achieved. Visual inspection of the transferred dispersion on the batch roll can be used to verify transparency of the carbon nanofibers to determine the proper front and rear roll nip tension adjustment settings of the three-roll mill. This technique can provide an optimum processing condition to break down agglomerates of the carbon nanofibers and minimize damage to the carbon nanofibers. This process can impart an impingement to the agglomerates followed by an elongational flow field that can physically align the carbon nanofibers to pass through the nips unharmed. This procedure can be repeated in "passes" until the minimum volume concentration of agglomerates are present thereby forming a first suspension (which includes the de-agglomerated carbon nanofibers in the liquid component).

Following de-agglomeration of the carbon nanofibers, a Horiba LA-910 Laser light scattering particle size analyzer can be used to quantify the amount and size of the agglomerate distribution of the carbon nanofibers. In one embodiment, the de-agglomerated carbon nanofibers contain particles less than about 60 microns in diameter.

In the event that laser light scattering particle size analysis is unavailable, an optical microscopy can be used to count and measure the agglomerates of carbon nanofibers present in the dispersion. For example, a microscope with multiple objectives (4× being preferred in this technique) can be used to determine the agglomerate density of the carbon nanofibers by diluting the dispersion and preparing a sample of known thickness and counting the agglomerates in the field of view. Then, using a 60× objective, the sample on the slide can be scanned and a measurement scale to the field of view can be applied to take size measurements of the largest agglomerates found in the sample on the slide.

After verification that the minimum volume concentration of agglomerates are present in the suspension, the suspension can then be post blended using a high shear Cowels blade to ensure homogeneity of carbon nanofiber distribution. In one embodiment, the first suspension (i.e., the carbon nanofibers dispersed in the liquid component) can be used by itself as the electrically conductive additive system to provide even higher levels of conductivity to thermoset composite systems (e.g., SMC compositions).

In another embodiment, if the dispersed carbon nanofibers in the suspension are to be used in synergy with conductive carbon black in the electrically conductive additive system, the conductive carbon black can be added separately to a liquid component (e.g., the same liquid component as discussed above regarding the first suspension) and mixed at hear shear conditions to disperse the conductive carbon black in the liquid component to form a second suspension. For example, a Cowles-type dispersion blade, which is two-thirds the diameter of the mixing vessel, can be used to blend the first and second suspension together at a constant speed of between about 500 to about 5000 rpm.

In one embodiment, the first suspension (which includes the de-agglomerated carbon nanofibers dispersed in the liquid component) and the second suspension (which includes the conductive carbon black dispersed in the liquid component) can be blended together under low shear conditions to form the electrically conductive additive system. For example, a propeller type mixing blade or other similar apparatus can be used. However, it will be appreciated that any suitable low shear mixer can be used.

In general, the SMC composition can be prepared by mixing, blending, or otherwise contacting at least two submixtures or parts together. The first submixture or part can generally contain a thermoset resin, monomer, filler, and additive(s). A second submixture or part can generally contain a non-thickening crosslinkable thermoset resin, low profile additive, monomer, thickening agent, pigment, and mold release agent. A fibrous reinforcing material may also be added to the SMC composition. In one embodiment, the electrically conductive additive system can be added to the first submixture. In another embodiment, the electrically conductive additive system can be added to the second submixture. In yet another embodiment, the electrically conductive additive system can be an additional submixture that is mixed or blended with the first and second submixtures.

The SMC composition described above may be used to mold various articles or parts including, but not limited to, automotive parts such as hoods or doors that may require a Class A finish, fenders, and supports (i.e., a smooth pit-free finish comparable to sheet metal counterpart panels).

Once the electrically conductive additive system has been processed as described above, it can be evaluated for its ability to render a test part electrically conductive. The electrically conductive additive system additive can be added to and mixed with a generic SMC composition. A test panel can then be molded from the generic SMC composition containing the electrically conductive additive system. The test panels can then be evaluated using appropriate methods and test equipment for measuring resistivity. One example includes preparing a molded test part for measurement using an ITW Ransburg Electrostatic Paintability Meter to provide consistent resistivity measurements. The method includes the use of a silver particle filled coating to cast two 1 inch×1 inch square leads 1" apart on a molded part. Ransburg external lead clips are then used to measure resistivity between the above-described leads. A second example includes the use of four point probe resistivity measurements. A Jandel RM2 (manufactured by Jandel Engineering Limited in Linslade, England) test unit or similar apparatus used in conjunction with a Jandel CYL-1.0-H-TC-500-8" four point probe head or similar apparatus provides consistent resistivity measurements. Resistivity measurements are used to qualify both the test parts and final production parts based on a correlation with the residual voltage measurements acquired using Ford Motor Company's BI 128-01 "Electrostatic Conductivity Test for Plastic Parts" standard test.

Table 1 below shows the residual voltage of a test panel molded from a generic SMC composition including carbon black (CB) alone and the electrically conductive additive system (i.e, carbon nanofibers (NF) and carbon black (CB)). The % conductive dry refers to the percent loading of the electrically conductive material (e.g., carbon nanofibers (NF) and carbon black) of the total SMC composition minus the fibrous reinforcing material. For the NF+CB, the ratio is 70% carbon black and 30% carbon nanofibers.

TABLE I

| | Maturation time | % Conductive Dry | Residual Voltage |
|---|---|---|---|
| Carbon Black | 48 hours | 0.36 | 70 |
| (NF + CB) | 48 hours | 0.54 | 20 |
| (NF + CB) | 10 Days | 0.54 | 5 |

Figure 2:
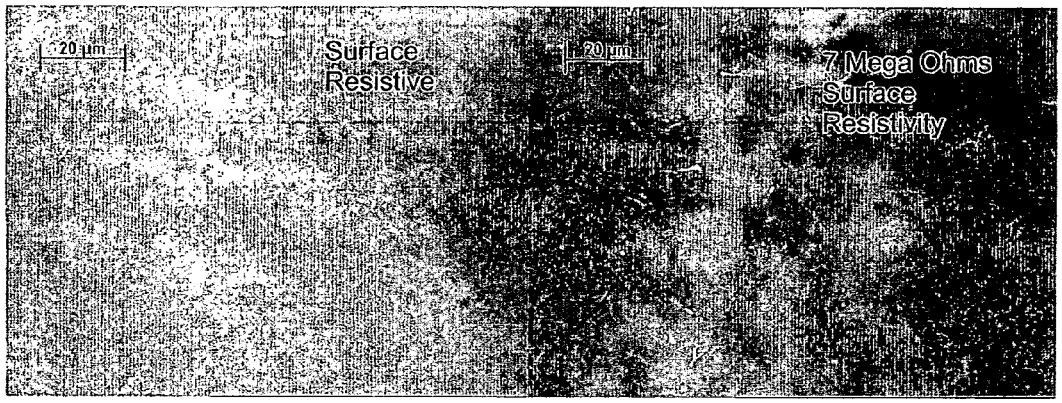
FIG. 2 are photomicrographs of molded test plaques with equivalent loadings of the electrically conducive material in a generic SMC system, wherein the left photomicrograph includes carbon black only at 0.5% loading and the right photomicrograph includes the present electrically conductive additive system that includes carbon nanofibers and carbon black at 0.5% loading with a 67/33 ratio of carbon black to carbon nanofibers.

FIG. 2 illustrates photomicrographs of molded test plaques with equivalent loadings of the electrically conducive material in a generic SMC system, wherein the left photomicrograph includes carbon black only at 0.5% loading and the right photomicrograph includes the present electrically conductive additive system that includes carbon nanofibers and carbon black at 0.5% loading with a 67/33 ratio of carbon black to carbon nanofibers.

The electrically conductive additive system and the methods described above can provide several benefits to the industry. First, the carbon nanofibers used herein posses low percolation thresholds, which has a minimal effect on the compound rheology and can provide a conductive network that is less sensitive to process variations. Second, the electrically conductive additive system that only includes carbon nanofibers, rather than carbon nanofibers and an electrically conductive particulate material, can produce a level of conductivity to the molded part that is orders of magnitude higher than that of carbon black only formulations. Third, the methods described above can create, evaluate, and control efficient and effective dispersion of the carbon nanofibers in a useable form.

Although the electrically conductive additive system has been described with specific reference to SMC compositions, the electrically conductive additive system can be used in other useful applications where electromagnetic shielding, electrostatic dissipation and antistatic properties are necessary such as in IC chip trays, electronic packaging, computer housings, etc.

While example systems, methods, and so on, have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, this application is not limited to the specific details, the representative apparatus, and illustrative examples shown and described and is intended to embrace alterations, modifications, and variations that fall within the scope of the appended claims. Furthermore, the preceding description is not meant to limit the scope of the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

What is claimed is:

1. An electrically conductive additive package comprising:

carbon nanofibers characterized by having a diameter between about 70 to about 200 nanometers, a length of about 50 to about 100 microns, and graphitic planes having a stacked cone-type structure; and conductive carbon black.

2. The additive package of claim 1 wherein the carbon nanofibers and conductive carbon black are dispersed in a liquid component.

3. The additive package of claim 2 further comprising a dispersing agent.

4. The additive package of claim 2 wherein the liquid component is selected from the group consisting of polyester grinding vehicles, polyol grinding vehicles, epoxies, plasticizers, monomers, and any combination thereof.

5. The additive package of claim 1 wherein the carbon nanofibers are further characterized by having a dispersive surface energy ranging between about 20 to about 285 $mJ/m^2$.

6. A method of preparing an electrically conductive additive package of claim 1, the method comprising the steps of:

preparing a first suspension including the carbon nanofibers dispersed in a first liquid component;

preparing a second suspension including the carbon black dispersed in a second liquid component; and mixing the first and second suspensions together to form the electrically conductive additive package.

7. The method of claim 6 wherein the step of preparing a first suspension includes de-agglomerating the carbon nanofibers present in the first suspension.

8. The method of claim 7 wherein the de-agglomeration step is accomplished by a three-roll mill.

9. The method of claim 6 wherein the first and second liquid components are substantially the same.

10. The additive package of claim 2 wherein the liquid component comprises between about 75 wt % and 98 wt % of the total additive package.

11. The additive package of claim 2 wherein the carbon nanofibers comprises between about 1 wt % and 15 wt % of the total additive package.

12. The additive package of claim 8 wherein the carbon black comprises between about 1 wt % and 20 wt % of the total additive package.

* * * * *